US006302713B1

(12) United States Patent
Lai

(10) Patent No.: US 6,302,713 B1
(45) Date of Patent: Oct. 16, 2001

(54) ROTATABLE CARD CONNECTOR

(75) Inventor: Ming-Chun Lai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,977

(22) Filed: Dec. 28, 2000

(30) Foreign Application Priority Data

Sep. 21, 2000 (TW) ..... 089216363

(51) Int. Cl.[7] ..... H01R 13/44; H01R 13/60
(52) U.S. Cl. ..... 439/131
(58) Field of Search ..... 439/131, 31, 165, 439/570, 64, 534

(56) References Cited

U.S. PATENT DOCUMENTS 6,231,371 * 6/1999 Helot ..... 439/131

* cited by examiner

*Primary Examiner*—Brian Sircus
*Assistant Examiner*—Javaid Nasri
(74) *Attorney, Agent, or Firm*—Wei Te Chung

(57) ABSTRACT

A rotatable card connector (1) includes an insulative housing (10), a number of terminals (40) received in the insulative housing, a pair of fixing clips (20), and a pair of separate locking members (30) for resiliently securing the fixing clips to the insulative housing. The pair of locking members provides a rotational axis around which the insulative housing is rotatable from an inclined, open position to a horizontal, closed position for allowing an external card to be connected with the terminals.

1 Claim, 6 Drawing Sheets

ROTATABLE CARD CONNECTOR

BACKGROUND OF THE INVENTION

1. Field of the Invention

The present invention relates to a card connector, and particularly to a card connector which rotates for facilitating insertion of an electrical card.

2. Description of Prior Art

U.S. Pat. Nos. 6,068,510, 6,071,135 and 6,077,088 disclose some conventional card connectors. In these designs, the card connector is normally fixed at an edge of a printed circuit board (PCB) located in an electronic device. In assembly, an electrical card is inserted through a cutout defined in a side plate of an enclosure of the electronic device into the card connector along a direction parallel to the card connector. In other words, this design is only suitable in situations where the card connector occupies an edge of the PCB. However, in some special situations, the edge of the PCB is not available for mounting the card connector since the space on PCBs is becoming increasingly critical. Accordingly, the conventional mounting arrangement is no longer applicable in these special situations. In other words, conventional card connectors cannot be used in situations where use of the board edge is denied. Hence, an improved card connector is required to overcome the disadvantages of the prior art.

Copending U.S. application Ser. No. 09/627,353, which was filed on Jul. 28, 2000 and is assigned to the same assignee as the present invention, discloses a rotatable card connector having two fixing clips fixed to a PCB. The fixing clips are pivotably engaged with two pivots integrally formed on opposite ends of an insulative housing of the card connector for allowing rotation of the card connector relative to the PCB. However, although this design has proven to be practical, a rotatable card connector having its fixing clips easily assembled to an insulative housing thereof is still desired. For facilitating understanding of the description of the present invention, the disclosure of the U.S. application Ser. No. 09/627,353 is incorporated herewith by reference.

SUMMARY OF THE INVENTION

Accordingly, one object of the present invention is to provide a rotatable card connector which can be mounted to a PCB of an electronic device, on one side of and not limited to the edges of the PCB;

Another object of the present invention is to provide a rotatable card connector for receiving an external electrical card from an inclined direction relative to the plane of the PCB on which the card connector is mounted.

Accordingly, a rotatable card connector in accordance with the present invention comprises an insulative housing with a plurality of terminals received therein, two fixing clips each with one end fixed to a PCB and another end attached to the housing, and two separate locking members for securing the fixing clips to the insulative housing. The insulative housing has a header forming a pair of protrusions at opposite ends thereof and two guiding bars. The locking members extend through aligned holes in the fixing clips and the protrusions to securely attach the fixing clips to the insulative housing and to provide a rotational axis for the fixing clips. Each fixing clip has a base plate for being fixed to a PCB, a joint portion extending from the base plate to prevent over-rotation of the housing, and an engaging portion for engaging with the protrusion.

When the card connector is retained in an inclined, open position where a front surface of the protrusion of the housing abuts against the joint portion of the fixing clip, an external electrical card is insertable into the card connector in an inclined direction along the guiding bar. The housing is rotatable from the inclined, open position to a horizontal, closed position where the electrical card can be completely inserted into the card connector and the front surface of the protrusion of the housing is spaced from the joint portion of the fixing clip.

Other objects, advantages and novel features of the invention will become more apparent from the following detailed description when taken in conjunction with the accompanying drawings.

DETAILED DESCRIPTION OF THE INVENTION

Figure 1:
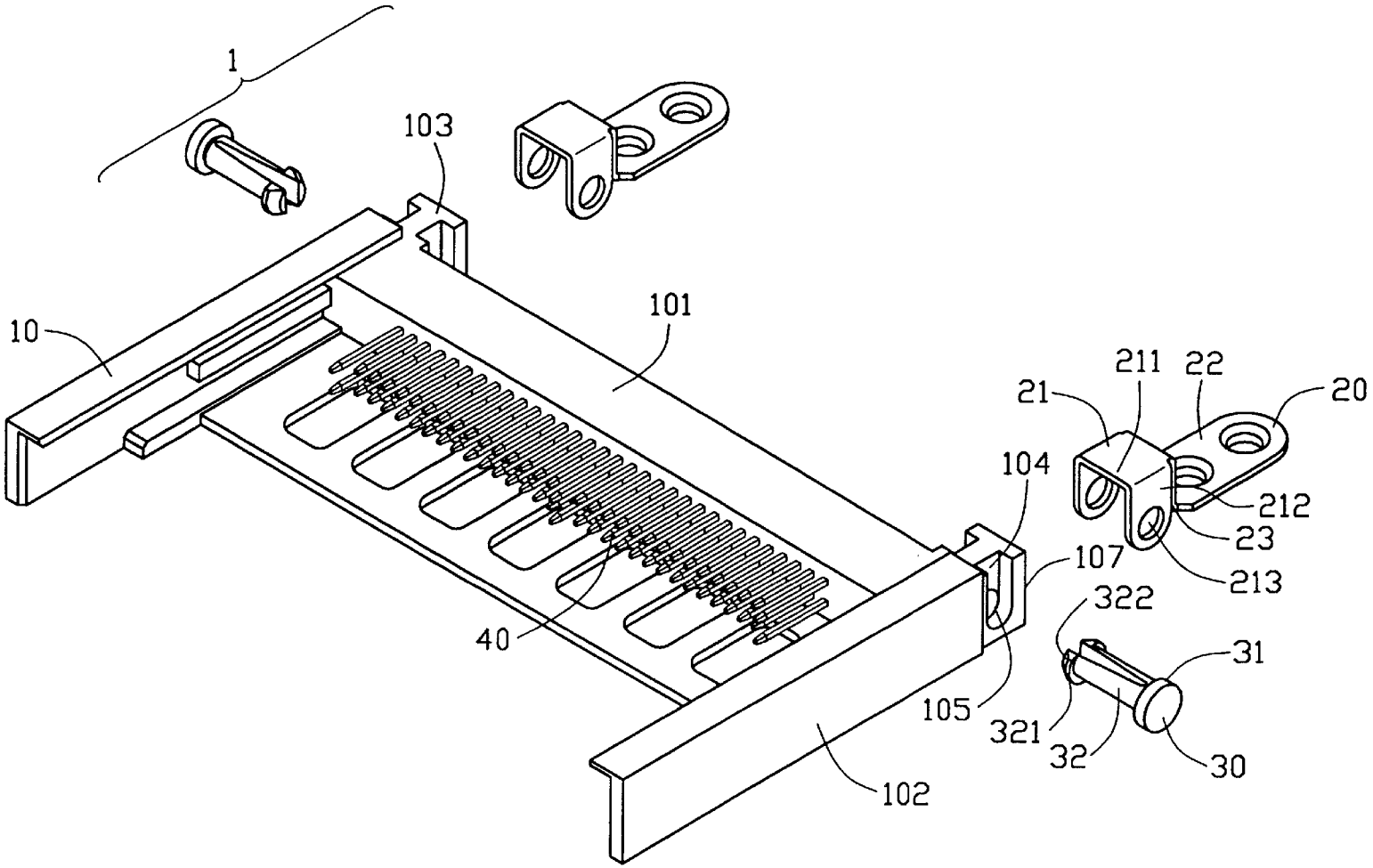
FIG. 1 is an exploded, perspective view of a rotatable card connector of the present invention.

Reference will now be made to the drawing figures to describe the present invention in detail.

Referring to FIG. 1, a rotatable card connector 1 in accordance with the present invention comprises an insulative housing 10, a plurality of terminals 40 retained in the insulative housing 10, a pair of fixing clips 20, and a pair of separate locking members 30 for securing the fixing clips 20 to the insulative housing 10. The card connector 1 is received in an opening defined in a printed circuit board (PCB) and is connected with the PCB via a flexible printed circuit board (FPC) and a board-to-board connector assembly (all not shown). Concerning the mounting arrangement of the card connector 1 and the PCB, reference may be made to U.S. application Ser. No. 09/627,353, incorporated herewith by reference.

The insulative housing 10 comprises a header 101 having a pair of protrusions 103 forwardly extending from opposite ends thereof, and a pair of guiding bars 102 extending rearward from opposite ends of the header 101. Each protrusion 103 defines a pair of opposite grooves 104 in lateral sides thereof and a through hole 105 in communication with the grooves 104.

Figure 2:
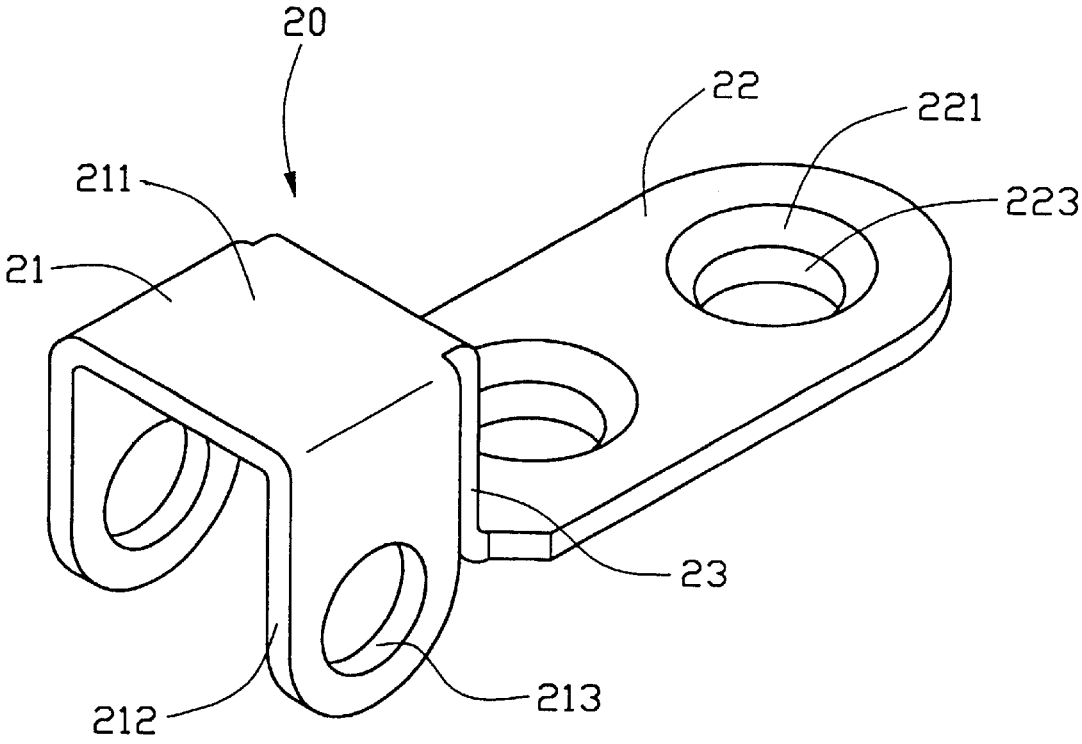
FIG. 2 is a perspective view of a fixing clip shown in FIG. 1.

Also referring to FIG. 2, each fixing clip 20 includes a U-shaped engaging portion 21 for engaging with the protrusion 103 of the insulative housing 10, a horizontal base plate 22 for being mounted on the PCB, and a vertical joint portion 23 interconnecting the engaging portion 21 and the base plate 22. The engaging portion 21 includes a horizontal section 211 connected with the base plate 22 by the joint portion 23, and a pair of tabs 212 downwardly extending from the horizontal section 211. An engaging hole 213 is defined in each tab 212 corresponding to the through hole 105 of the insulative housing 10 for receiving the locking member 30. The base plate 22 defines two mounting holes 221 and two collars 223 formed on a bottom surface thereof (best seen in FIGS. 4 and 6). The collars 223 are adapted to be engaged with the PCB by additional securing devices, such as bolts, extending through the mounting holes 221.

Each locking member 30 includes a cap 31 and a bifurcated body 32. A large-dimensioned lobe 321 is formed on the free end of the body 32 and has a curved guiding surface 322 for facilitating insertion into corresponding engaging holes 213 of the fixing clip 20 and the through hole 105 of the insulative housing 10.

Figure 3:
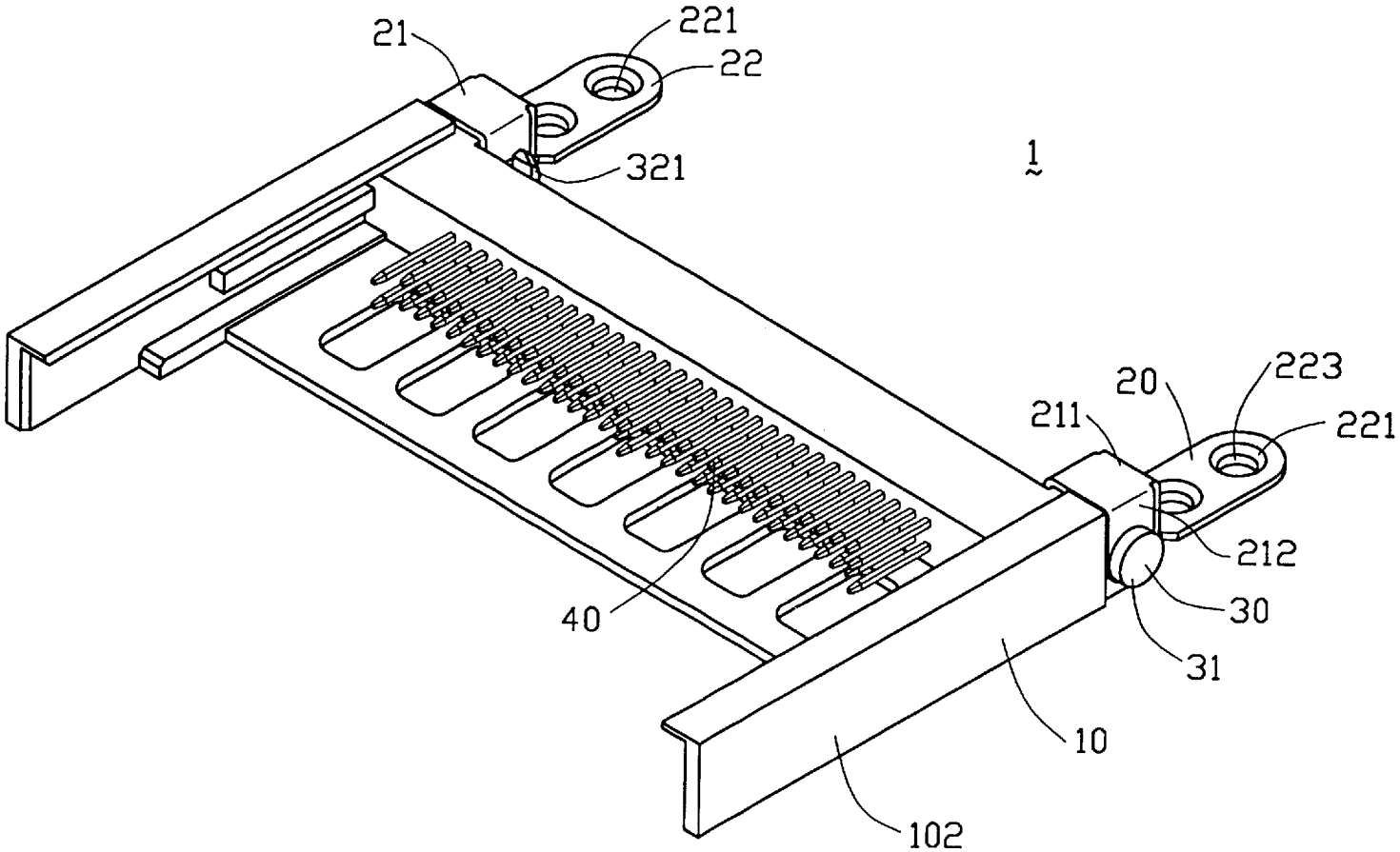
FIG. 3 is an assembled view of FIG. 1 showing the rotatable card connector in a horizontal, closed position.
Figure 4:
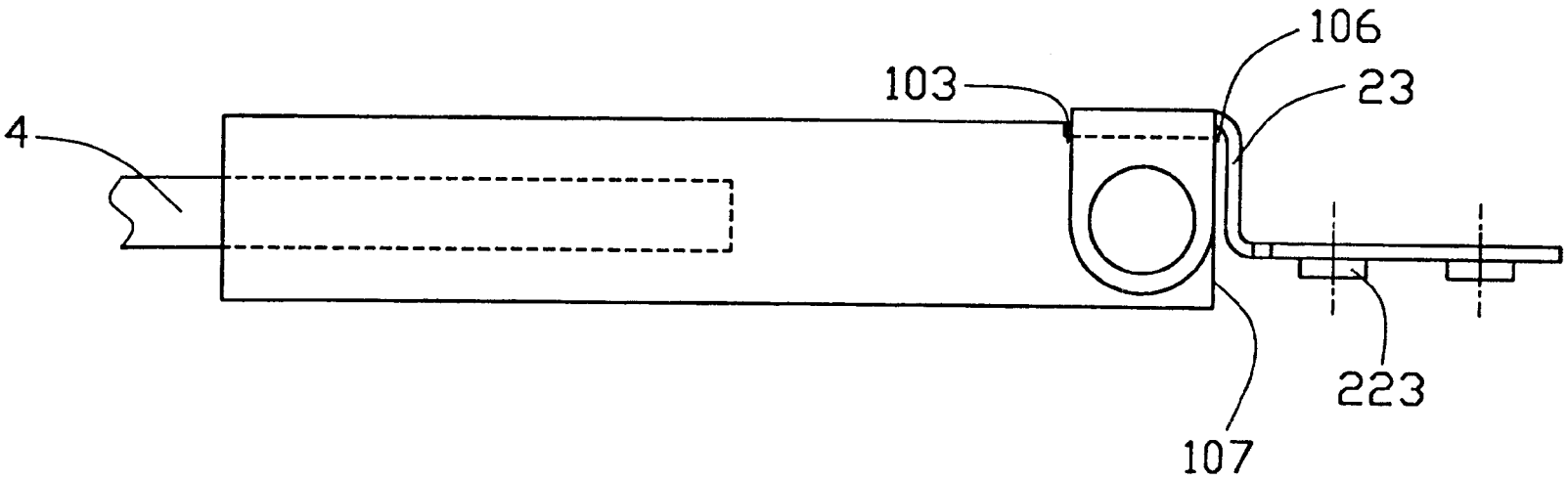
FIG. 4 is a side view of FIG. 3 with an electrical card completely inserted in the rotatable card connector.

As is illustrated in FIGS. 3 and 4, in assembly, the fixing clips 20 are first fixed to the PCB via a set of screws extending through the mounting holes 221 and the collars 223 and engaging with a pair of nuts (not shown). The fixing clips 20 are then attached to the protrusions 103 of the insulative housing 10 with the horizontal sections 211 and the tabs 212 of the U-shaped engaging portions 21 thereof respectively abutting against an upper surface and opposite side surfaces of the corresponding protrusions 103. A gap 106 is defined between the joint portion 23 of each fixing clip 20 and a front surface 107 of the corresponding protrusion 103. The engaging holes 213 of the engaging portions 21 are aligned with the corresponding through holes 105 of the protrusions 103. Each locking member 30 is then compressively extended through the corresponding aligned engaging holes 213 and through hole 105 with the cap 31 and the large-dimensioned lobe 321 thereof engaging with outer surfaces of the tabs 212 for rotatably securing the fixing clip 20 to the protrusion 103.

Figure 5:
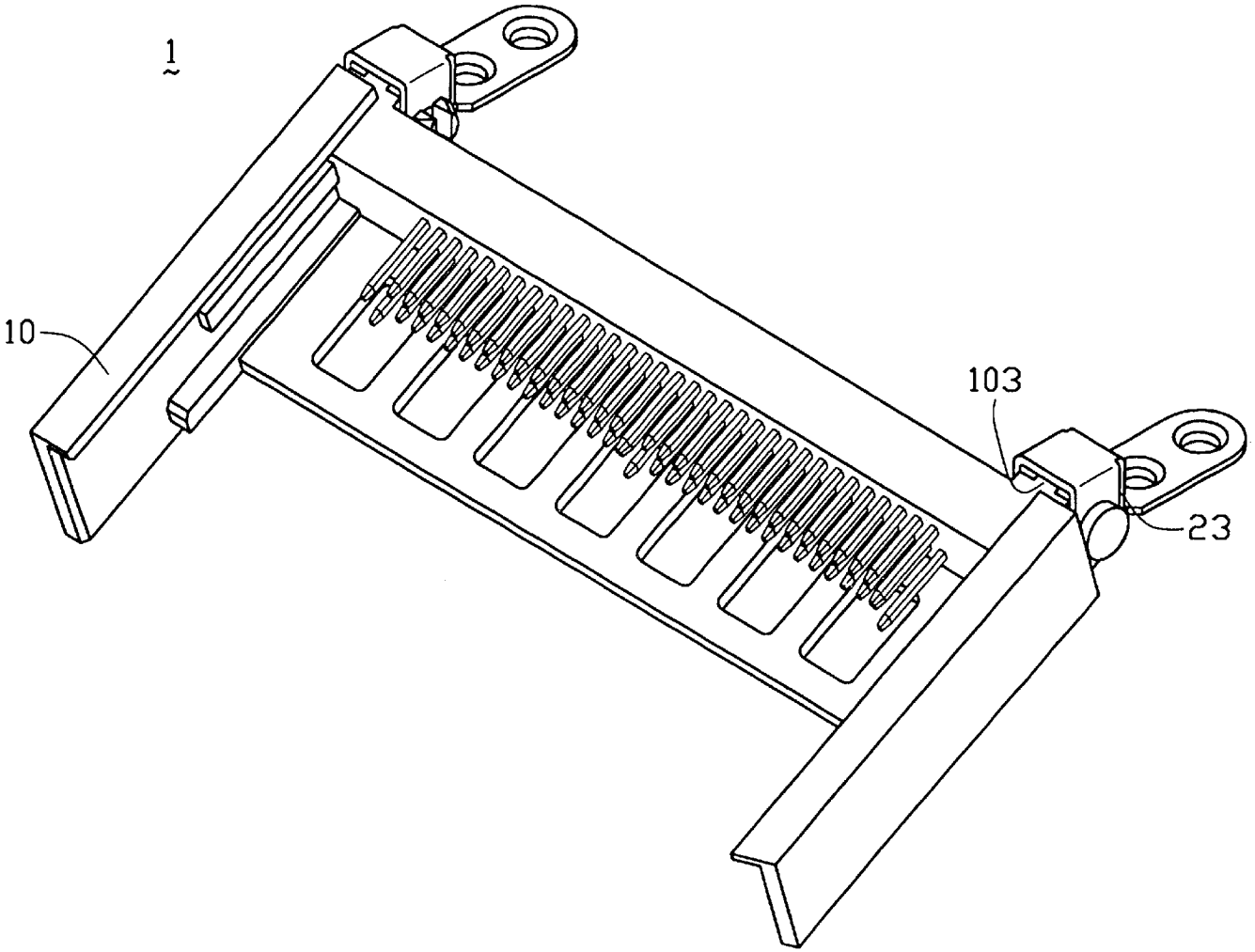
FIG. 5 is a perspective view showing the rotatable card connector in an inclined, open position.
Figure 6:
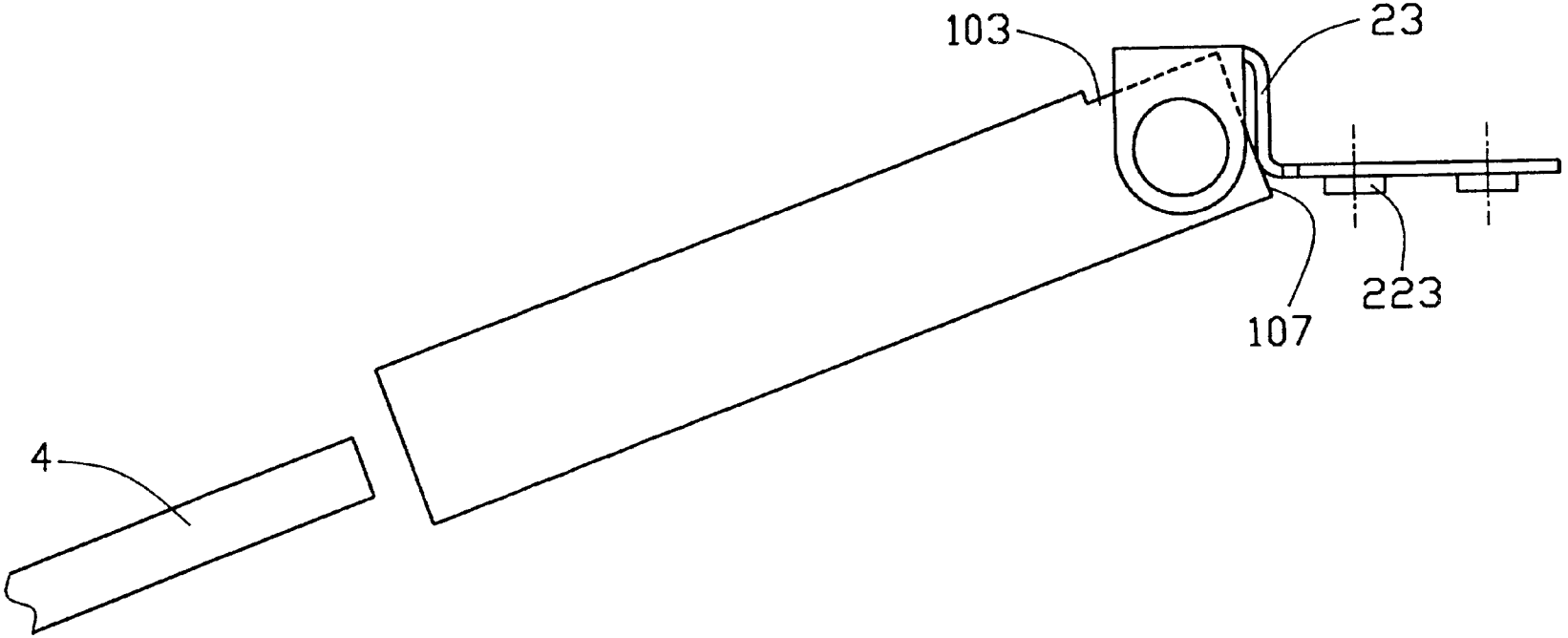
FIG. 6 is a side view of FIG. 5 with an electrical card ready to be inserted in the rotatable card connector.

To insert or withdraw an external electrical card 4, the insulative housing 10 is rotatable anticlockwise (from the perspective of FIGS. 4 and 6) around the locking members 30 relative to the fixing clips 20 from the horizontal, closed position shown in FIGS. 3 and 4 to an inclined, open position as illustrated in FIGS. 5 and 6. In the inclined, open position, the front surfaces 107 of the protrusions 103 of the insulative housing 10 abut against corresponding joint portions 23 of the fixing clips 20, whereby further rotational movement of the insulative housing 10 is prevented. In this position, the card 4 is loosely inserted into or withdrawn from a loosened position in the card connector 1 along the direction of the guiding bar 102. Then the insulative housing 10 is rotated clockwise around the locking members 30 to return to the horizontal, closed position as shown in FIGS. 3 and 4, and the card 4 is completely inserted into the card connector 1 to engage with the terminals 40 of the card connector 1. Therefore, an electrical connection is established between the card 4 and the PCB via the terminals 40 of the card connector 1, the FPC and the board-to board connector assembly.

By the design of the present invention, the card connector 1 can be mounted on a side of the PCB and the electrical card 4 can be inserted or withdrawn from the card connector 1 in an inclined direction relative to the fixing clip 20. The provision of the separate locking members 30 significantly facilitates the assembly of the fixing clips 20 to the protrusions 103 of the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rotatable card connector for connecting an external electrical card with a printed circuit board on which the card connector is mounted, comprising:

an insulative housing having a header, the header having a pair of protrusions on opposite end thereof, each protrusion defining a through hole therein;

a plurality of terminals retained in the header of the insulative housing;

two fixing clips each having a base plate adapted to be fixed to a printed circuit board, an engaging portion engaged with the protrusion of the insulative housing, and a joint portion connecting the engaged portion with the base plate, the engaging portion defining at least one engaging hole in alignment with the through hole of the protrusion; and two separate locking members each extending into a corresponding aligned at least one engaging hole of the fixing clip and through hole of the protrusion for resiliently and detachable securing the fixing clip to the protrusion of the insulative housing;

wherein the insulative housing is rotatable around a rotational axis provided by the locking members from an inclined, first position to a horizontal, second position for allowing an inserted external electrical card to electrically connect with the printed circuit board;

wherein the engaging portion of the fixing clip is U-shaped and includes a horizontal section engagable with an upper surface of the protrusion and a pair of tabs downwardly extending from the horizontal section and abutting against opposite lateral side surfaces of the protrusion, and wherein the at least one engaging hole comprises two engaging holes respectively defined in the pair of tabs;

wherein the locking member includes a cap and a body having a large-dimensioned lobe formed on a free end thereof, the body being bifurcated for providing resiliency thereto, the cap and the lobe engaged with opposite side surfaces of the engaging portion of the fixing clip;

wherein the joint portion of the fixing clip is engaged with the protrusion when the insulative housing is in the inclined, first position and is spaced from the protrusion when the insulative housing is in the horizontal, second position.

* * * * *